US005262745A

United States Patent [19]

Gutierrez

[11] Patent Number: 5,262,745

[45] Date of Patent: Nov. 16, 1993

[54] SURFACE MOUNTED MULTI-SECTION BOBBIN

[75] Inventor: Aurelio J. Gutierrez, San Diego, Calif.

[73] Assignee: Pulse Engineering, Inc., San Diego, Calif.

[21] Appl. No.: 825,986

[22] Filed: Jan. 27, 1992

[51] Int. Cl.[5] ..... H01F 15/10; H01F 27/30

[52] U.S. Cl. ..... 336/192; 336/208; 439/818

[58] Field of Search ..... 361/403; 338/322, 325; 336/198, 208, 192; 439/816, 818, 827, 786; 310/71

[56] References Cited

U.S. PATENT DOCUMENTS 3,684,993 8/1972 Hazen et al. ..... 336/192

FOREIGN PATENT DOCUMENTS 62-122109 6/1987 Japan ..... 336/192

63-287011 11/1988 Japan ..... 336/192

3-194908 8/1991 Japan ..... 336/192

*Primary Examiner*—Thomas J. Kozma

*Attorney, Agent, or Firm*—Baker, Maxham, Jester & Meador

[57] ABSTRACT

A bobbin for surface mounting on a printed circuit board comprises an elongated support body constructed of a non-conducting material having a plurality of curved winding support areas bound on each side by a generally rectangular mounting member having recesses in opposed surfaces thereof, and a combined mounting and lead terminal member having opposed gripping fingers engaging the recesses, one of the fingers having a free end extending outward therefrom for conductively connecting with a lead.

16 Claims, 2 Drawing Sheets

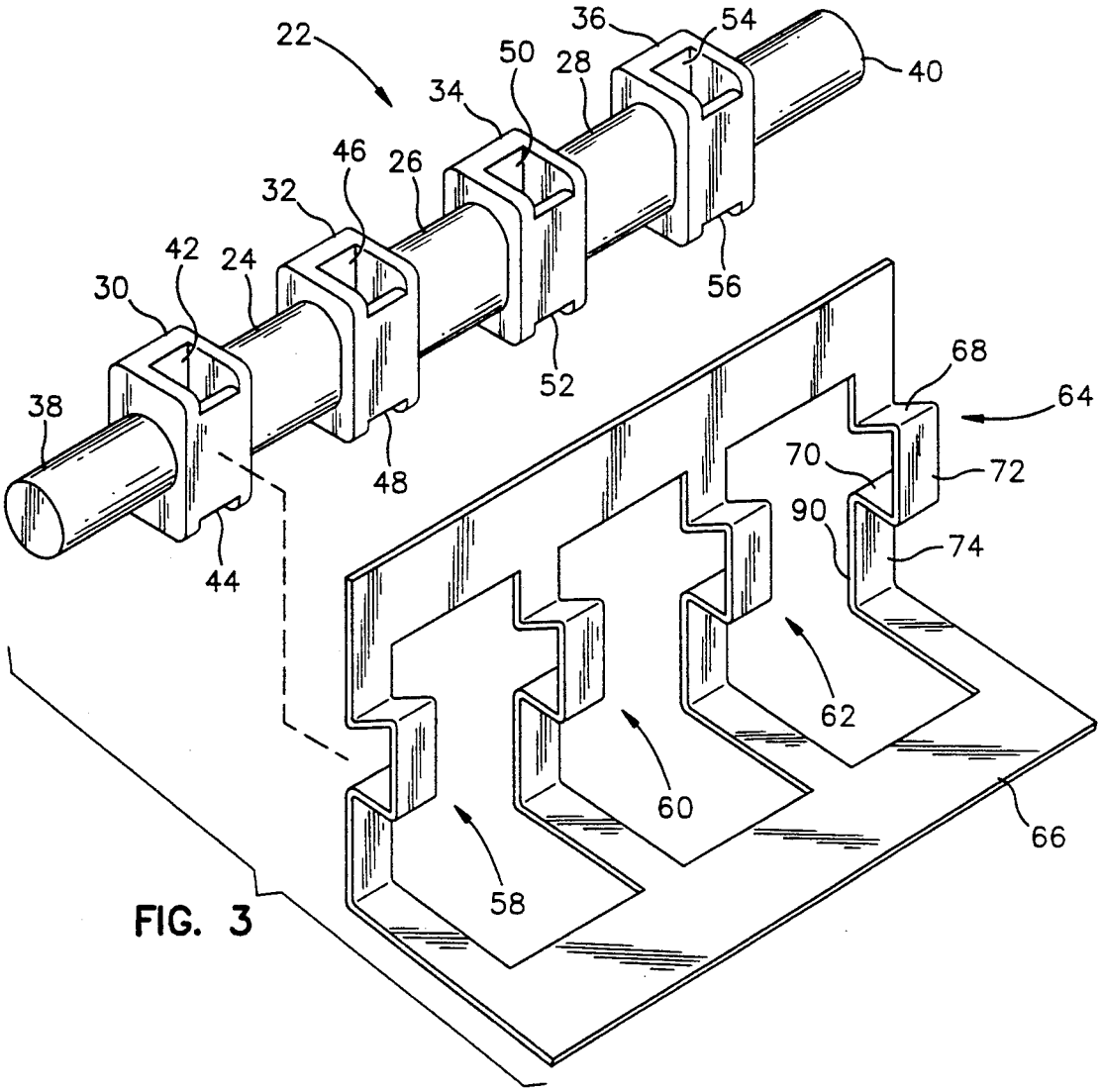
FIG. 3
FIG. 5
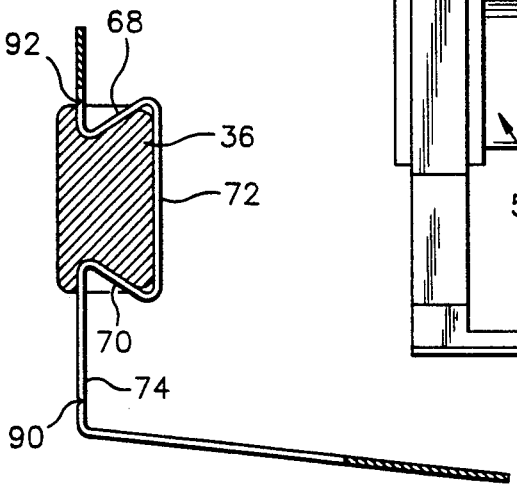
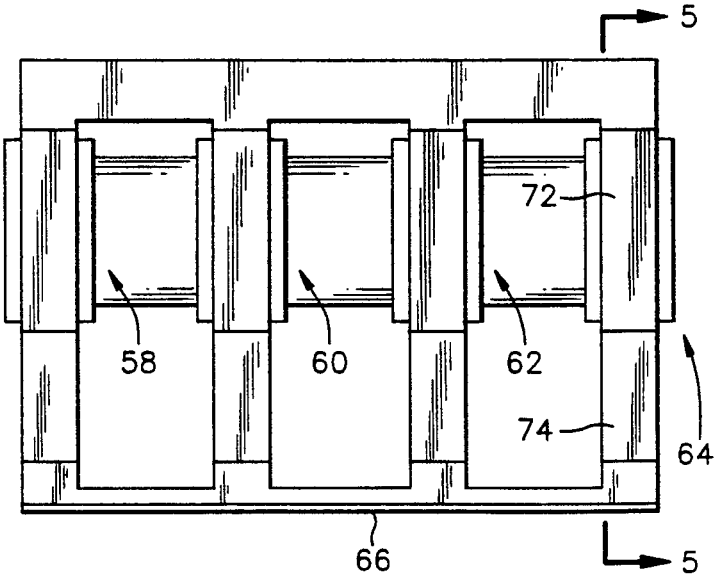
FIG. 4

SURFACE MOUNTED MULTI-SECTION BOBBIN

BACKGROUND OF THE INVENTION

The present invention relates to non-semiconductor microminiature electronic elements, and pertains particularly to an improved package and method of surface mounting of multi-section bobbins.

For many years, electronic circuit boards have been fabricated by interconnecting a plurality of electronic components, both active and passive, on a planar printed circuit board. Typically, this printed circuit board has comprised an Epoxy/fiberglass laminate substrate clad with a sheet of copper, which has been etched to delineate the conductive paths. Holes were drilled through terminal portions of the conductive paths for receiving electronic component leads, which were subsequently soldered thereto.

More recently, so-called surface mount technology has evolved to permit more efficient automatic mass production of circuit boards with higher component densities. With this approach, certain packaged components are automatically placed at preselected locations on top of a printed circuit board, so that their leads are registered with and lie on top of corresponding solder paths or pads. The printed circuit board is then processed by exposure to infrared or vapor phase soldering techniques to re-flow the solder, and thereby establish a permanent electrical connection between the leads and their corresponding conductive paths on the printed circuit board.

Among the electrical and electronic elements that must be surface mounted on PC boards are multi-section bobbins. A bobbin is a small insulated spool, which serves as a support for a coil or wire wound resistor. The current technique of surface mounting of a multi-section bobbin is by the surface mounting of flying leads, as illustrated in FIG. 1 of the drawings. The current technique of mounting is time consuming, difficult to machine wind and tap, and frequently results in reliability problems.

The increasing miniaturization of electrical and electronic elements and high density mounting thereof has created increasing problems with electrical isolation and mechanical interconnection. In particular, it creates more difficulty establishing reliable and efficient connection between fine gauge (AWG 24 to AWG 50) copper wires and terminals. Presently known interconnect methods severely limit the ability to provide density and reliable electrical and mechanical isolation between distinct egress or terminal points due to space limitations.

The prior art approach, as illustrated in FIG. 1, is to select an insulated bobbin 10 of suitable length, and wind a wire 11 forming a first coil 12 with a lead or terminal 13 at one end and a lead 14 at the other end. The wire is wound to form additional coils 15, 16 and 17, with leads 18, 19, and 20 for mounting and connection to a PC board. These leads are commonly called flying leads and are solder connected to a PC board. In addition, the lead is also frequently broken as the result of thermal expansion and contraction of the leads and/or terminals.

It is, therefore, desirable that an improved package and method of mounting of multi-section bobbins be available.

SUMMARY AND OBJECTS OF THE INVENTION

It is the primary object of the present invention to provide an improved package and method of mounting of multi-section bobbins.

In accordance with a primary aspect of the present invention, an electronic device having a plurality of leads comprises a three dimensional holder of a non-conducting material, having at least one coil support surface thereon and a plurality of leads extending from a coil on the support surface to a conductive connector base of the holder, with a plurality of leads extending within slots from the element to the base, and a plurality of lead terminals mounted on the holder, and each having one end extending into and along one of the slots parallel to and into conducting engagement with a lead, and a free end extending outward therefrom.

BRIEF DESCRIPTION OF THE DRAWING

The above and other objects and advantages of the present invention will become apparent from the following description when read in conjunction with the accompanying drawings wherein:

FIG. 3 is an exploded perspective view illustrating major components and initial steps in assembling the invention;

FIG. 4 is view from the bottom illustrating an intermediate stage in assembling the invention; and FIG. 5 is a section view taken on line 5—5 of FIG. 4.

DETAILED DESCRIPTION OF A PREFERRED EMBODIMENT

Figure 1:
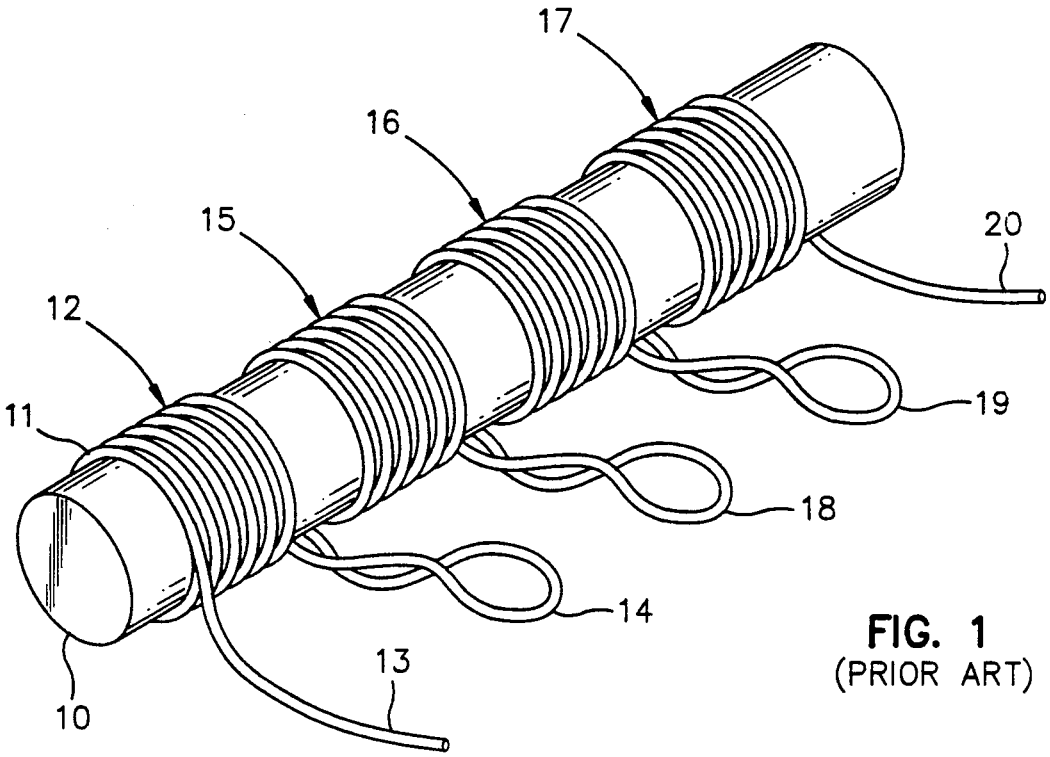
FIG. 1 (PRIOR ART)
FIG. 1 is a perspective view illustrating the prior art.
Figure 2:
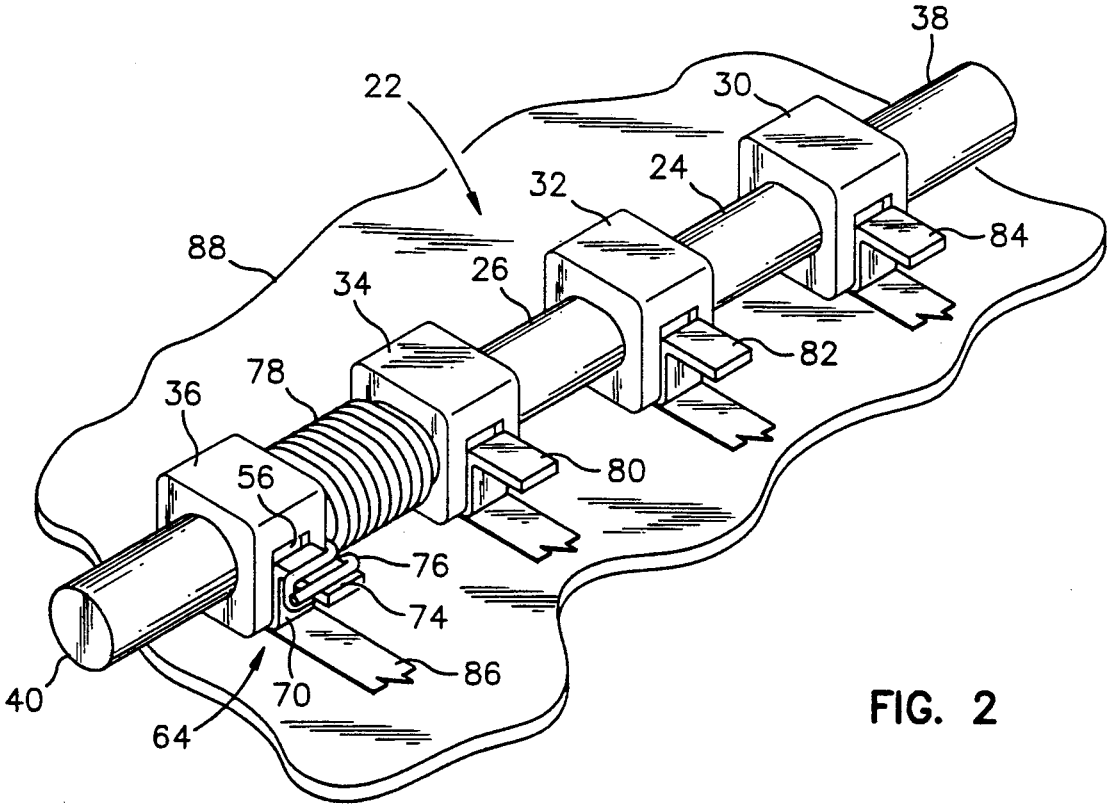
FIG. 2 is a perspective view illustrating a preferred embodiment of the invention.

Referring to FIG. 2 of the drawings, there is illustrated an exemplary embodiment of the invention, designated generally by the numeral 22. The illustrated embodiment of the invention comprises a specially constructed bobbin for support of coils or wire wound resistors. The bobbin comprises an elongated body constructed of a non-conductive material, and having a plurality of winding support surfaces 24, 26 and 28. These winding support surfaces may have any suitable cross-sectional configuration, such as the illustrated oval or elliptical configuration. They may also be cylindrical or any other suitable configuration. The elliptical configuration may be preferred for some applications, because it has a lower profile for a given winding.

Each of the winding support areas is separated from adjacent support areas and is bound on both ends by means of a support member, which in the illustrated embodiment, is in the form of a generally rectangular block 30, 32, 34, and 36. These blocks serve as first mounting means supporting the respective winding support areas above the surface of a PC board, and providing means for receiving combined conductive wire and pad connectors. The bobbin unit is also provided with cylindrical extensions or spindles 38 and 40 at each end thereof for the purpose of enabling easier winding of the coils by machine or other suitable means. These spindles are removed in any suitable manner after the coils are wound.

With reference to FIG. 3, each of the mounting and separating blocks 30, 32, 34 and 36 is provided with opposed recesses. These recesses, as will be explained with respect to block 30, extend inward from opposed sides, forming a generally C-shaped cavity for receiving opposed fingers of a clip on conductive mounting means connector, as will be explained.

As specifically illustrated in FIG. 3, the mounting blocks 30–36 have recesses 42 and 44, 46 and 48, 50 and 52, 54 and 56, respectively. These opposed recesses or cavities are designed to receive opposed fingers of combined mounting and lead terminal connector members, designated generally at 58, 60, 62 and 64, initially formed on a lead frame 66.

The terminal connector members are identical and only one will be described in detail. The terminal member 64, for example, comprises conductive metal formed of a pair of opposing fingers 68 and 70 extending upward from a planar base member 72 and inward toward one another at about a 20 forty-five (45) degree angle to the base. The fingers curve outward at the upper ends and extend about parallel to the base. The opposed or clipping finger 70 has an outwardly extending free tab or terminal end 74 extending outward therefrom. The tab 74 is for the connection of a lead or wire 76 of a coil 78, as shown in FIG. 2. Similar tabs or connectors 80, 82 and 84 are provided by the mounting and terminal connector members for the other winding areas. A coil 78 of wire is wound on the winding support area, and the terminal end 76 of the coil is wrapped around the tab 74 and 80 of each of the mounting and terminal connectors. The base portion of each of the mounting and terminal connectors overlie or rest on solder pads or paths 86 on a PC board 88.

The overall assembly is manufactured by forming the bobbin unit 22 in a molding machine, for example of a non-conducted material, into a shape such as that illustrated in FIGS. 2 and 3. A lead frame 66, as illustrated in FIG. 3, is formed as shown having the clip on mounting and connector members 58, 60, 62 and 64, as illustrated, with break away notches at 90 and 92. The unit is brought together, as illustrated in FIG. 3, and snapped together as shown in FIGS. 4 and 5, with the fingers of the lead mounting and connector members extending into the respective recesses or cavities of the respective support or mounting members 30, 32, 34 and 36. The excess portions of the lead frame are then broken away at 90 and 92, leaving the individual clips on the unit as illustrated in FIG. 2.

The unit may then be wound with suitable wire on the respective winding support areas or members, and the terminal ends of the wires connected to the terminal tabs 74, 80, 82 and 84. The terminal tabs 74, 80, 82 and 84 may be dipped into a molten solder to secure the connection. The unit is then suitably positioned on a PC board and soldered to the respective bonding pads. Soldering may be accomplished by any suitable process, such as reflow or the like.

The unit, as above described, is simple and inexpensive to manufacture, and easy to mount and connect to the PC board by automatic assembly machines.

While I have illustrated and described my invention by means of specific embodiments, it should be understood that numerous changes and modifications may be made therein without departing from the spirit and scope of the invention as defined in the appended claims. I further assert and sincerely believe that the above specification contains a written description of the invention and the manner and process of making and using it, in such full, clear, concise, and exact terms as to enable any person skilled in the art to which it pertains, or with which it is most nearly concerned, to make and use the same, and further that it sets forth the best mode contemplated by me for carrying out the invention.

I claim:

1. A bobbin for surface mounting on a printed circuit board, comprising:

an elongated support body having a longitudinal axis and constructed of a non-conducting material having at least one winding support area bound on each side by a first mounting means having recess means in oppositely directed laterally positioned surfaces thereof; and a conductive combined mounting and lead terminal member having a central flat planar bonding surface extending parallel to said longitudinal axis for surface mounting to a PC board and opposed gripping fingers at each end of said bonding surface engaging said recess means, one of said fingers having a free end extending outward therefrom for conductively connecting with a lead.

2. A bobbin according to claim 1 wherein said support body has a plurality of winding support areas separated from one another by said first mounting means.

3. A bobbin according to claim 2 wherein said plurality of winding support areas have a generally curved surface.

4. A bobbin according to claim 3 wherein said first mounting means comprises a member having a generally rectangular outer configuration and said recess is formed opposite sides thereof.

5. A bobbin according to claim 4 wherein said opposed gripping fingers extend inward toward one another at about a forty-five degree angle to said planar bonding surface and curve outward at the outer tip.

6. A bobbin according to claim 1 wherein said opposed gripping fingers extend inward toward one another at about a forty-five degree angle to said planar bonding surface and curve outward at the outer tip.

7. A bobbin according to claim 6 wherein said support body has a plurality of winding support areas separated from one another by said first mounting means.

8. A bobbin according to claim 7 wherein said plurality of winding support areas have a generally elliptical surface.

9. A bobbin according to claim 7 wherein said first mounting means comprises a member having a generally rectangular outer configuration and said recess is formed in opposite sides thereof.

10. A bobbin according to claim 7 further comprising a coil of wire on each of said plurality of winding support areas and having the ends thereof connected to one of said combined mounting and lead terminal members.

11. A bobbin for surface mounting on a printed circuit board, comprising:

an elongated support body having a longitudinal axis and constructed of a non-conducting material having a plurality of curved winding support areas bound on each side by a first mounting means having a generally rectangular outer configuration and having recess means in opposite surfaces thereof; and a combined mounting and lead terminal member having a central flat planar bonding surface extending parallel to said longitudinal axis for surface mounting to a PC board and opposed gripping fingers extending outward at an angle at each end of said bonding surface engaging said recess means, one of said fingers having a free end extending outward therefrom for conductively connecting with a lead.

12. A bobbin according to claim 11 wherein said opposed gripping fingers extend inward toward one another at about a forty-five degree angle to said bonding surface and curve outward at the outer tip.

13. A bobbin according to claim 11 wherein said plurality of winding support areas have a generally elliptical configuration.

14. A bobbin according to claim 11 further comprising a coil of wire on each of said plurality of winding support areas and having the ends thereof connected to one of said combined mounting and lead terminal members.

15. A bobbin for surface mounting on a printed circuit board, comprising:

an elongated support body having a longitudinal axis and constructed of a non-conducting material having a plurality of curved winding support areas bound on each side by a first mounting means having a generally rectangular outer configuration and having recess means in opposite surfaces thereof; and a combined mounting and lead terminal member having a flat planar bonding surface extending parallel to said longitudinal axis for bonding to a printed circuit board, and a pair of opposed gripping fingers at opposite ends of said bonding surface extending outward and inward toward one another at about a forty-five degree angle and curve outward at the outer tip engaging said recess means, one of said fingers having a free end extending outward therefrom for conductively connecting with a lead.

16. A bobbin according to claim 15 wherein said plurality of winding support areas have a generally elliptical configuration; and further comprising a coil of wire on each of said plurality of winding support areas and each having an end thereof connected to one of said combined mounting and lead terminal members.

* * * * *